US008342719B2

(12) United States Patent
Takase et al.

(10) Patent No.: US 8,342,719 B2
(45) Date of Patent: Jan. 1, 2013

(54) LED LIGHT BULB

(75) Inventors: Motoki Takase, Osaka (JP); Masako Horiyama, Osaka (JP); Junichi Somei, Osaka (JP); Yuji Kozuma, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 156 days.

(21) Appl. No.: 12/985,544

(22) Filed: Jan. 6, 2011

(65) Prior Publication Data

US 2011/0170299 A1 Jul. 14, 2011

(30) Foreign Application Priority Data

Jan. 8, 2010 (JP) ..... 2010-003409

(51) Int. Cl.
*F21V 3/00* (2006.01)
*F21V 5/00* (2006.01)

(52) U.S. Cl. ..... 362/311.02; 362/249.02; 362/800

(58) Field of Classification Search ..... 362/249.02, 362/311.02, 800
See application file for complete search history.

(56) References Cited

U.S. PATENT DOCUMENTS

| | | | |
|---|---|---|---|
| 6,749,320 | B1 | 6/2004 | Hartley |
| 2003/0057886 | A1 | 3/2003 | Lys et al. |
| 2003/0057887 | A1 | 3/2003 | Dowling et al. |
| 2003/0057890 | A1 | 3/2003 | Lys et al. |
| 2003/0137258 | A1 | 7/2003 | Piepgras et al. |
| 2004/0052076 | A1 | 3/2004 | Mueller et al. |
| 2004/0212320 | A1 | 10/2004 | Dowling et al. |
| 2004/0240890 | A1 | 12/2004 | Lys et al. |
| 2005/0036300 | A1 | 2/2005 | Dowling et al. |
| 2005/0047134 | A1 | 3/2005 | Mueller et al. |
| 2005/0062440 | A1 | 3/2005 | Lys et al. |
| 2005/0116667 | A1 | 6/2005 | Mueller et al. |
| 2005/0174473 | A1 | 8/2005 | Morgan et al. |
| 2005/0275626 | A1 | 12/2005 | Mueller et al. |
| 2005/0285547 | A1 | 12/2005 | Piepgras et al. |
| 2007/0206375 | A1 | 9/2007 | Piepgras et al. |
| 2007/0237284 | A1 | 10/2007 | Lys et al. |
| 2008/0019123 | A1 | 1/2008 | Catalano et al. |
| 2008/0310158 | A1 | 12/2008 | Harbers et al. |
| 2009/0175044 | A1 | 7/2009 | Veenstra et al. |
| 2009/0303731 | A1 | 12/2009 | Chang |
| 2009/0310368 | A1 | 12/2009 | Incerti et al. |
| 2011/0157898 | A1 | 6/2011 | Kanai |

FOREIGN PATENT DOCUMENTS

CN 2829098 Y 10/2006

(Continued)

OTHER PUBLICATIONS

EP Search Report mailed Apr. 5, 2011 for corresponding European Application No. 11150248.0.

*Primary Examiner* — Jason Moon Han
(74) *Attorney, Agent, or Firm* — Nixon & Vanderhye, P.C.

(57) ABSTRACT

In an LED light bulb, an LED module and a lens are disposed on a fixing stage provided to a housing. The lens has a concave portion at its top end. The concave portion forms a reflecting surface which reflects part of outgoing light from the LED module to (i) first directions perpendicular to a front emission direction of the outgoing light or (ii) second directions leaning to a cap beyond the first directions. Due to diffusion effect of an optical cover, part of the light reflected by the lens is emitted backward (toward the cap). This realizes an LED light bulb that distributes light over an entire circumference and has high output as well as high light output ratio.

13 Claims, 6 Drawing Sheets

FOREIGN PATENT DOCUMENTS

| | | | |
|---|---|---|---|
| CN | 1900753 | A | 1/2007 |
| CN | 1913179 | A | 2/2007 |
| CN | 101055907 | A | 10/2007 |
| CN | 201259105 | Y | 6/2009 |
| CN | 101479522 | A | 7/2009 |
| JP | 2001-243807 | | 9/2001 |
| JP | 2004-343025 | | 12/2004 |
| JP | 2007-294295 | | 11/2007 |
| JP | 2007-310419 | | 11/2007 |
| JP | 2007-317431 | | 12/2007 |
| JP | 2009-187951 | | 8/2009 |
| WO | 2004/104642 | A2 | 12/2004 |
| WO | 2007/125564 | A1 | 8/2007 |
| WO | WO 2008/007492 | A1 | 1/2008 |

LED LIGHT BULB

This Nonprovisional application claims priority under 35U.S.C. §119(a) on Patent Application No. 2010-003409 filed in Japan on Jan. 8, 2010, the entire contents of which are hereby incorporated by reference.

TECHNICAL FIELD

The present invention relates to an LED light bulb which has high light output ratio and can emit light over a wide angular range.

BACKGROUND ART

A recent increase of environmental awareness has been stimulating a replacement of a power-consuming illumination light source such as an incandescent light bulb with a power-saving light source. For example, as disclosed in Patent Literature 1, LEDs are coming into use in many cases instead of incandescent light bulbs. An LED has high luminous efficiency. Moreover, unlike fluorescent lamps, it is mercury-free. Therefore, the LED is highly expected as an environment-friendly light source. The LED is a point light source and has high directivity. As such, it has a feature of emitting intense light forward, i.e., to an emission direction.

On the other hand, as illustrated in FIG. 11, an incandescent light bulb 101 includes a bulb 102, a cap 103 provided at an end of the bulb 102, and a filament 104 provided inside the bulb 102. In such an incandescent light bulb 101, the filament 104 which serves as a point light source emits light. As a result, except a part that is hidden by the cap 103, the light is emitted over an almost entire circumference, or 360 degrees, as illustrated in FIG. 12.

Thus, the LED light bulb has a smaller light distribution angular range than an incandescent light bulb. Therefore, to be improved in practicality, the LED light bulb should be elaborated, in light distribution, to be more equivalent to the incandescent light bulb. Patent Literature 1, for example, discloses providing a plurality of LEDs on an outer wall of a tubular member that extends perpendicularly from a flat surface. With this configuration, it is possible to expand the light distribution angular range. However, this light bulb has disadvantages as follows: (i) The LEDs are externally visible, thereby making the light bulb less attractive aesthetically. (ii) A complex configuration of a substrate increases a cost. A technique which has no such disadvantages and can solve the foregoing problems with a more simple configuration is exemplified by the following.

In a first example, a LED light bulb is configured such that a cover is made of a highly diffusive resin or glass with a haze value of almost 99%. This makes it possible to expand the light distribution angular range.

In a second example, a LED light bulb is configured such that small-sized LED light sources are disposed to emit light in lateral directions, and that a dome-like lens (domed lens) is provided in the LED light bulb (see Patent Literature 2, for instance). In this example, light, being laterally dispersed to some extent, is diffused by a cover made of a highly diffusive resin or glass. The LED with the domed lens disclosed in Patent Literature 2 is presumably a lamp type LED. However, in terms of heat dissipation and the like, this kind of LED cannot be realized by a high-power LED. Moreover, the light bulb of Patent Literature 2 uses low-power LEDs. This requires to array a number of LEDs including LEDs surrounding the LED with the domed lens so as to emit light also in lateral directions. However, this results in a decrease in conversion efficiency from electric energy to light in a case where a number of high-power LEDs are used. In terms of efficiency, it is preferable that the light be emitted by one LED module.

CITATION LIST

Patent Literature 1

Japanese Patent Application Publication Tokukai No. 2001-243807 A (Published on Sep. 7, 2001)

Patent Literature 2

Japanese Patent Application Publication Tokukai No. 2004-343025 A (Published on Dec. 2, 2004)

SUMMARY OF INVENTION

Technical Problem

In the first example, the taller the cover is, the more backward (to directions toward the cap of the LED light bulb) the light is emitted. In other words, if the cover is not tall enough, the light is not emitted backward. Furthermore, highly diffusive materials often have low transmissivity (high reflectivity). Therefore, use of such materials for the cover causes light output ratio (light extraction efficiency from the light source) to be decreased. This leads to a loss of light quantity in a course of repetitive reflection of the light inside the light bulb between components (components other than the LED light source) and the cover. In addition, the cover itself causes a loss of the light quantity by a few percent. As a consequence, about 10% of the light quantity is lost, thereby achieving insufficient brightness with respect to brightness of the light source.

Meanwhile, the second example can expand, compared to the first example, the light distribution angular range even if the cover is short. On the other hand, the second example is disadvantageous in that it is difficult to adjust a plurality of LEDs in terms of light distribution. Moreover, as in the first example, the second example has low light output ratio.

Solution to Problem

An object of the present invention is to provide an illumination device that distributes light over a wide angular range and has high output as well as high light output ratio.

An LED light bulb of the present invention includes: an LED module which serves as a light source; a fixing stage on which the LED module is fixed; a housing which holds the fixing stage; an optical cover attached to the housing so as to cover the LED module; a cap attached to the housing so that the cap is on one side of the housing and the optical cover is on an opposite side of the housing; and a lens which directs part of outgoing light from the LED module to (i) first directions perpendicular to a front emission direction of the outgoing light or (ii) second directions leaning to the cap beyond the first directions.

With the above configuration, light is emitted from a light exit plane of the LED module omnidirectionally around a front emission direction of the light. The light emitted in directions more leaned toward directions perpendicular to the front emission direction is lower in intensity. The lens directs part of the outgoing light from the LED module to (i) first directions perpendicular to the front emission direction of the outgoing light or (ii) second directions leaning to the cap beyond the first directions. This allows the LED light bulb to emit light that passes through the lens as well as light directed to lateral directions. As a result, the light can be emitted over a wide angular range.

Advantageous Effects of Invention

As described above, the LED light bulb according to the present invention includes a lens which directs part of outgoing light to (i) first directions perpendicular to a front emission direction of the outgoing light or (ii) second directions leaning to the cap beyond the first directions. Therefore, by setting reflection directions of the lens properly, the light distribution can be easily adjusted, and blocking the outgoing light by the housing and the like can be reduced, thereby raising the light output ratio.

BRIEF DESCRIPTION OF DRAWINGS

FIG. 1 is a side view illustrating a configuration of an LED light bulb according to Embodiment 1 of the present invention.

FIG. 2 is an enlarged plane view illustrating where an LED module is located in the LED light bulb.

FIG. 3 is a cross-sectional view taken along line A-A in FIG. 2.

FIG. 4 is a light distribution diagram showing a light distribution of an LED only.

FIG. 5 is a light distribution diagram showing a light distribution in a case where an LED module and a lens (and no optical cover) are provided in the LED light bulb.

FIG. 6 is a light distribution diagram showing a light distribution in a case where an LED module, a lens, and an optical cover are provided in the LED light bulb.

FIG. 7 is an enlarged plane view illustrating where an LED module is located in a modification of the LED light bulb according to Embodiment 1.

FIG. 8 is a cross-sectional view taken along line B-B in FIG. 7

FIG. 9 is a side view illustrating a configuration of an LED light bulb according to Embodiment 2 of the present invention.

FIG. 10 is an enlarged plane view illustrating where an LED module is located in the LED light bulb of FIG. 9.

FIG. 11 is a side view illustrating a configuration of a conventional incandescent light bulb.

FIG. 12 is a light distribution diagram showing a light distribution of the conventional incandescent light bulb.

DESCRIPTION OF EMBODIMENTS

[Embodiment 1]

The following describes an embodiment of the present invention with reference to FIGS. 1 to 4.

Figure 1:
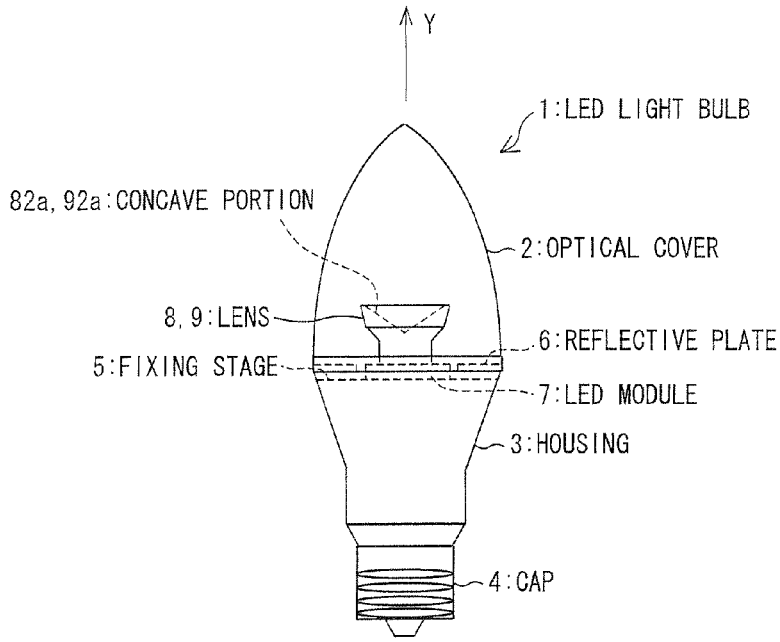
FIG. 1
Figure 2:
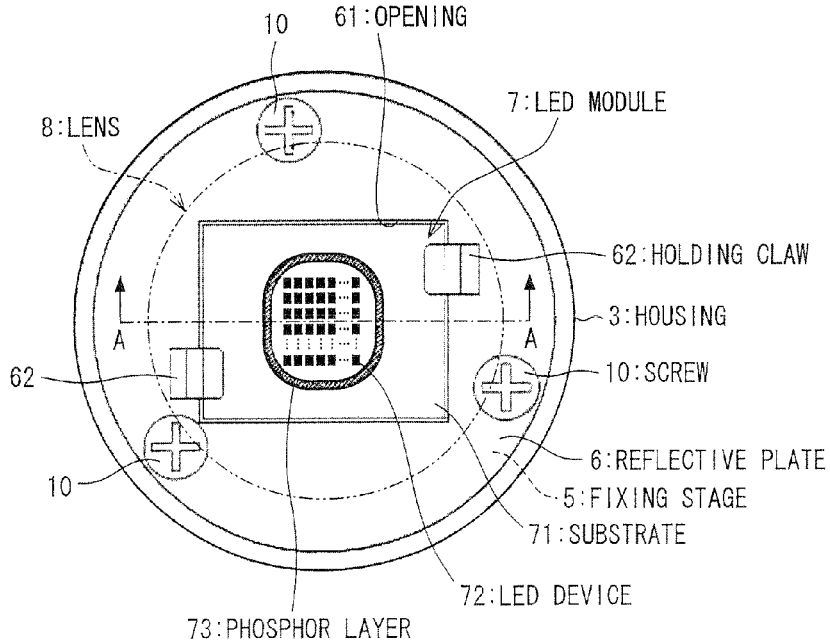
FIG. 2
Figure 3:
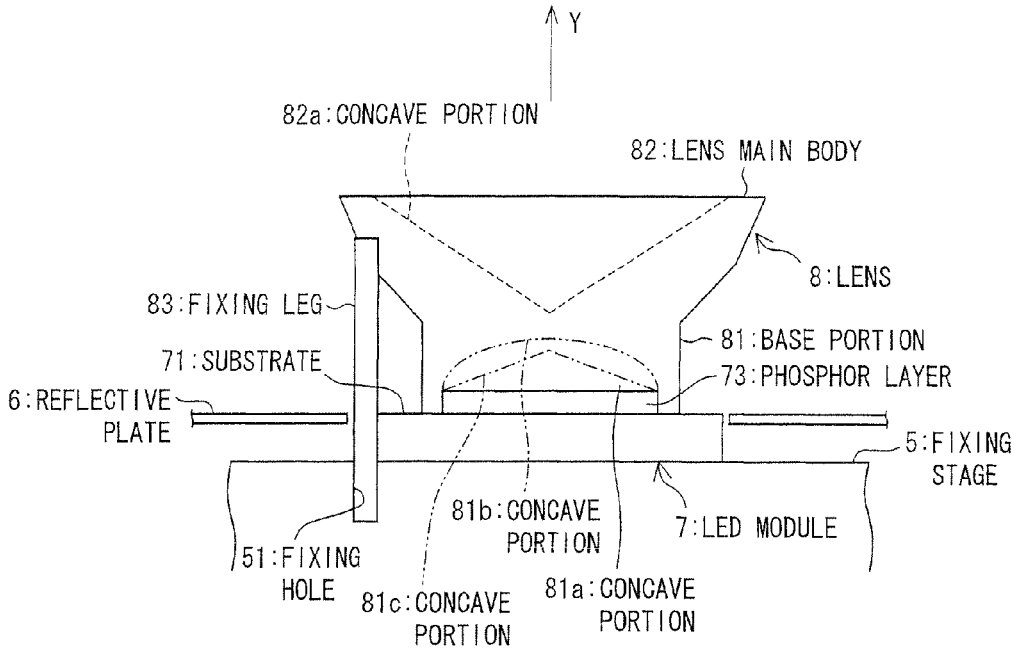
FIG. 3

FIG. 1 illustrates an LED light bulb 1 according to the present embodiment. FIG. 2 is an enlarged view illustrating where an LED module 7 and a lens 8 are located in the LED light bulb 1. FIG. 3 is a cross-sectional view taken along line A-A in FIG. 2, illustrating a structure of the lens 8 in the LED light bulb 1.

(Configuration of LED Light Bulb)

As illustrated in FIGS. 1 and 2, the LED light bulb 1 includes an optical cover 2, a housing 3, a cap 4, a fixing stage 5, a reflective plate 6, and the LED module 7.

The optical cover 2, thorough which the light emitted from the LED module 7 passes, covers the LED module 7 for protection. The optical cover 2 is made of a transparent resin or glass. It is particularly preferable that the optical cover 2 be made of a light-diffusive resin having a haze value of 99%. A surface of the optical cover 2 may be processed to have a diamond-like cutting pattern. This can ensure high light diffuseness. The optical cover 2 has a shape with a sharp end (pointed shape). Note that the optical cover 2 may not be formed to have the pointed shape but to have a spherical or curved shape.

The housing 3 contains a plurality of driving circuit components for driving the LED module 7 and a power supply that generates a direct voltage to be supplied to the driving circuit components (the driving circuit components and the power supply are not illustrated). Further, the optical cover 2 is attached to the housing 3, and the LED module 7 is fixed on the fixing stage 5. The housing 3 has not only a heat dissipation function for the driving circuit components and the power supply but also a function for dissipating heat generated in the LED module 7.

The cap 4 is electrically connected to the driving circuit components. The cap 4 further has a screw mechanism so as to be screwed into a socket that is connected to an external power supply. The cap 4 is attached to one end (a tapered end) of the housing 3.

The fixing stage 5 is provided at the other end (an end opposite to the end to which the cap 4 is attached) of the housing 3. The fixing stage 5 is formed to have a flat top surface so that the LED module 7 and the reflective plate 6 are fixed thereon.

The LED module 7, which serves as a light source, has a substrate 71, LED devices 72, and a phosphor layer 73. The substrate 71 is formed to have a rectangular shape and fixed on the fixing stage 5. On a center of the substrate 71, a plurality of LED devices 72 are mounted so as to be spaced apart from each other. Further, in a region on the substrate 71 where the LED devices 72 are mounted, the phosphor layer 73 is provided so as to cover the LED devices 72. A top surface of the phosphor layer 73 is formed to be approximately flat.

The reflective plate 6 is provided for a purpose of reflecting outgoing light which is emitted from the LED module 7 and reflected by the optical cover 2 and the lens 8 toward the fixing stage 5. The reflective plate 6 is fixed on the fixing stage 5 at three points by screws 10. Further, the reflective plate 6 is disposed so as to be spaced apart from the fixing stage 5 by a certain distance by, for example, a spacer (not illustrated) through which the screws 10 are inserted. The spacer also serves for disposing the reflective plate 6 in such a manner that the top surface of the reflective plate 6 is at an approximately same height as the top surface of the substrate 71. On a center of the reflective plate 6 is provided a rectangular opening 61. The opening 61 is formed to be slightly larger than the top surface of the substrate 71, so that the top surface of the substrate 71 is exposed through the opening 61. The reflective plate 6 additionally has, in the vicinities of two opposing corners of the opening 61, two holding claws 62 projecting toward the substrate 71.

The holding claws 62 hold the substrate 71 to fix the LED module 7 on the fixing stage 5. As a result, the LED module 7 is held also by the reflective plate 6. The LED light bulb 1 is often disposed in such a manner that the LED module 7 faces downward. With this configuration, the LED module 7 is prevented from being suspended from the LED light bulb 1.

As illustrated in FIG. 3, the lens 8 is provided for directing (reflecting) part of the outgoing light from the LED module 7 to predetermined directions. The lens 8 includes a base portion 81, a lens main body 82, and fixing legs 83. The base portion 81 has a cylindrical shape and is disposed on the substrate 71. The base portion 81 is provided with a concave portion 81*a* for containing the phosphor layer 73. A top surface of the concave portion 81*a* is formed to be flat so as to fit the top surface of the phosphor layer 73.

Note that the base portion 81 may be provided with, instead of the concave portion 81*a*, a concave portion 81*b* or a concave portion 81*c*. The concave portion 81*b* has a curved top surface so that the outgoing light from the LED module 7 enters almost vertically into the lens from the concave portion 81*b*. The concave portion 81*c* has a top surface which forms a curved surface of a conical shape.

The lens main body 82 is provided on the base portion 81, and increases in diameter toward the top end of the base portion 81 (i.e., the lens main body 82 has a tapered shape with the largest diameter on top). The lens main body 82 is also provided with a concave portion 82*a* on its top end face. The concave portion 82*a* forms a curved surface of a conical shape having a reflecting surface which reflects part of the outgoing light from the LED module 7 to (i) directions perpendicular to a straight direction (Y direction), i.e., a front emission direction of the outgoing light or (ii) directions leaning to the cap 4 beyond the perpendicular directions. Directions to which the light reflected by the concave portion 82*a* travels are defined by an inclined angle of the surface of the concave portion 82*a* to the Y direction.

The fixing legs 83 are provided for fixing the lens 8 on the fixing stage 5 and positioning the lens 8. There appears to be only one fixing leg 83 in FIG. 3. However, on a side surface of the lens main body 82, a plurality of fixing legs 83 are provided at even intervals. The fixing legs 83 are each formed such that an end thereof is attached to the side surface of the lens main body 82, while the other end (leading end) extends downward. The other end of each fixing leg 83 is inserted into a fixing hole 51 provided in the fixing stage 5. This allows the lens 8 to be firmly fixed on the fixing stage 5. In addition, this makes it easy to position the lens 8 on the substrate 71.

Here, the fixing hole 51 is provided to extend downward along a side surface of the substrate 71. The reflective plate 6 has such a shape that the reflective plate 6 is along a periphery of each fixing leg 83. With this configuration, each fixing leg 83 is held by being sandwiched between the reflective plate 6 and the substrate 71 at its peripheries.

(What is Realized by LED Light Bulb)

In the LED light bulb 1 thus configured, the light is emitted from the light exit plane of the LED module 7 omnidirectionally around a front emission direction of the light (Y direction). The light emitted in directions more leaned toward directions perpendicular to the front emission direction is lower in intensity. In other words, the light which travels to the Y direction (straight light) has the highest light intensity.

A part of the light emitted from the LED module 7 passes through the lens 8 and goes out. The rest of the light is reflected by a reflecting surface of the concave portion 82*a* and directed to directions perpendicular to the Y direction or directions leaning to the cap 4 beyond the perpendicular directions. In consequence, the light is emitted through the lens 8 to lateral directions or more backward (toward the cap 4). Due to a diffusion effect of the optical cover 2, part of the light emitted through the lens 8 is directed further backward. If the optical cover 2 has a shape tapered to a peak, in particular, the light diffusion effect is enhanced and the light is emitted over a wider angular range.

Further, providing the lens main body 82 on the base portion 81 allows the light to be reflected in a higher position with respect to the fixing stage 5. This makes it possible to reduce an angular range in which the reflected light is blocked by the housing 3 and the like. In addition, by setting an inclined angle of the concave portion 82*a* properly, the light distribution angular range can easily be adjusted. A decrease of the outgoing light from the LED light bulb 1 can be alleviated by using the reflective plate 6 to further reflect the light which has been reflected to the vicinity of the LED module 7 from the lens 8 or from the optical cover 2 after being passed through the lens 8.

Moreover, providing the base portion 81 with a concave portion 81*b* can reduce a loss of light quantity. A part of the light emitted from the LED module 7 travels to the front emission direction (Y direction), while the rest of the light enters invertically into the lens 8. The latter is partly reflected by the lens 8, thereby causing a loss of light quantity. On the other hand, if the outgoing light from the LED module 7 enters vertically into the lens 8, the loss of light quantity is kept as small as possible. Therefore, it is possible to reduce the loss of light by forming the concave portion 81*b* so as to have a curved shape (preferably a hemispherical shape), so that the outgoing light from the LED module 7 enters almost vertically into the lens 8 from the concave portion 81*b*.

Further, by providing the base 81 with the concave portion 81*c*, the outgoing light from the LED module 7 is refracted toward a center of the lens 8 at entering into the lens 8. As such, it is possible to increase the light which travels to the lateral directions in comparison with the concave portion 81*a*. This allows to increase the light emitted toward the back of the LED light bulb 1.

(Comparison of Light Distribution Angular Ranges)

Figure 4:
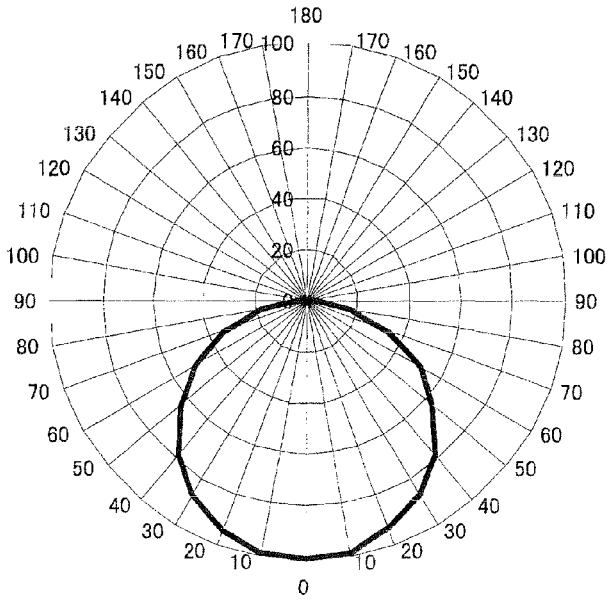
FIG. 4
Figure 5:
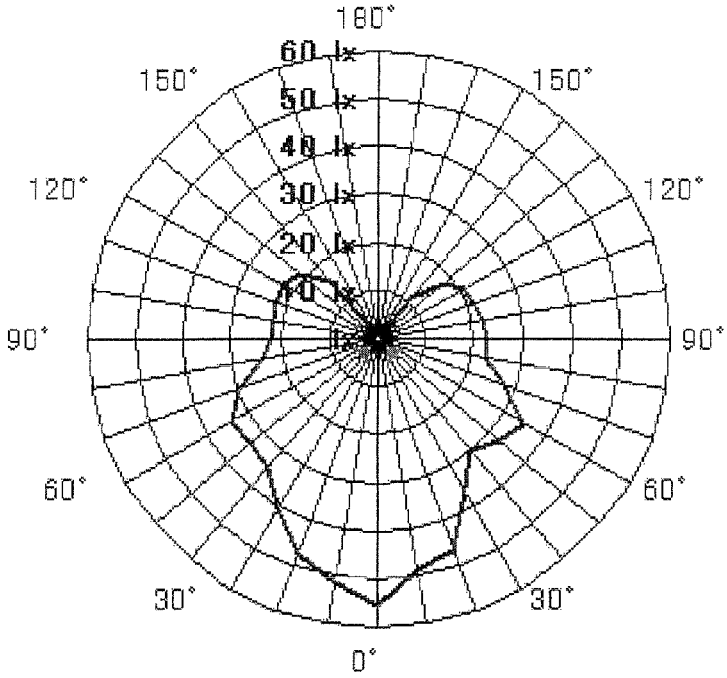
FIG. 5
Figure 6:
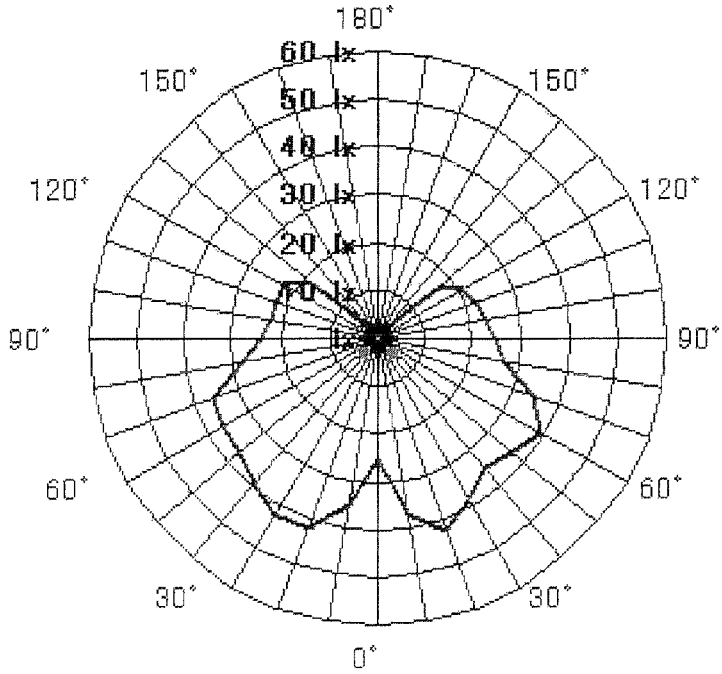
FIG. 6

FIG. 4 shows a light distribution angular range of an LED only, and FIG. 5 shows a light distribution angular range in a case where only the lens 8 is additionally provided. FIG. 6 shows a light distribution angular range in a case where both the optical cover 2 and the lens 8 are employed.

Compared to FIG. 4, it can be found in FIG. 5 that a small portion of the outgoing light from the LED module 7 is directed backward by the lens 8 when the outgoing light passes through the lens 8. If the optical cover 2 is additionally provided, the light to be directed forward decreases, and the light to be directed in the lateral directions and toward the cap 4 increases.

Table 1 shows relationships between total luminous flux and light output ratio in a case where the optical cover 2 and the lens 8 are provided. As shown in Table 1, the light output ratio indicates about 95%. That is, the loss is suppressed to about 5%.

TABLE 1

| | Only LED | With lens | With lens and optical cover |
|---|---|---|---|
| Total luminous flux [lm] | 373 | 354 | 352 |
| Light output ratio [%] | — | 94.8 | 94.3 |

[Modification]

Subsequently, a modification of the present embodiment is described with reference to FIGS. 7 and 8.

Figure 7:
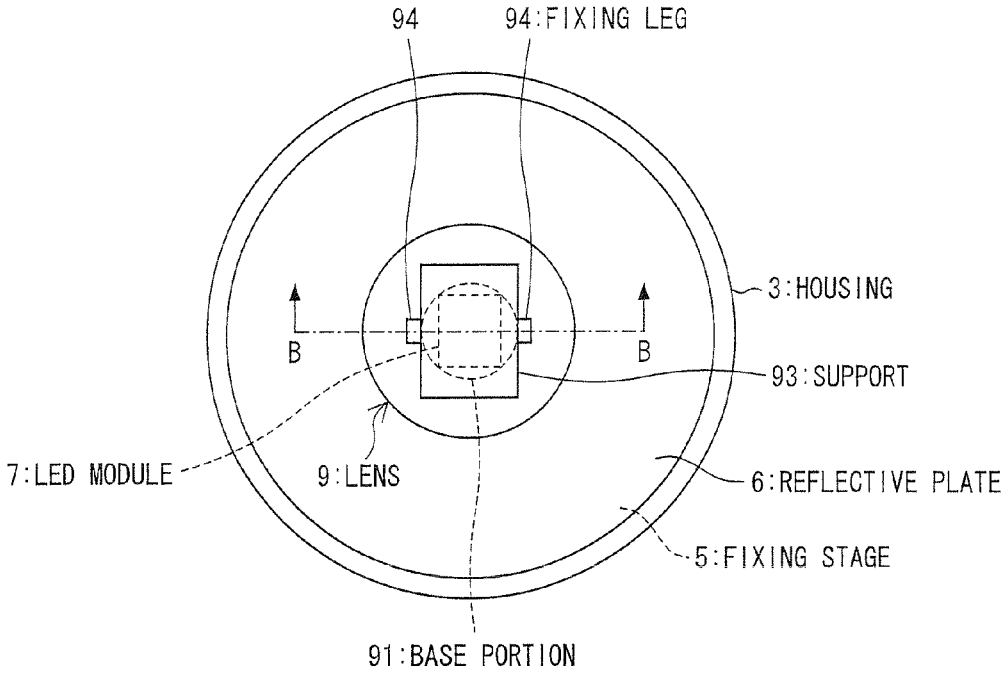
FIG. 7

FIG. 7 is a plane view illustrating an LED light bulb 1 according to the present modification. FIG. 8 is a cross-sectional view taken along line B-B in FIG. 7, illustrating a structure of a lens 9 in the LED light bulb 1.

(Configuration of LED Light Bulb)

In the present modification, a lens 9 is provided instead of the lens 8 in the LED light bulb 1 illustrated in FIGS. 1 and 2.

Figure 8:
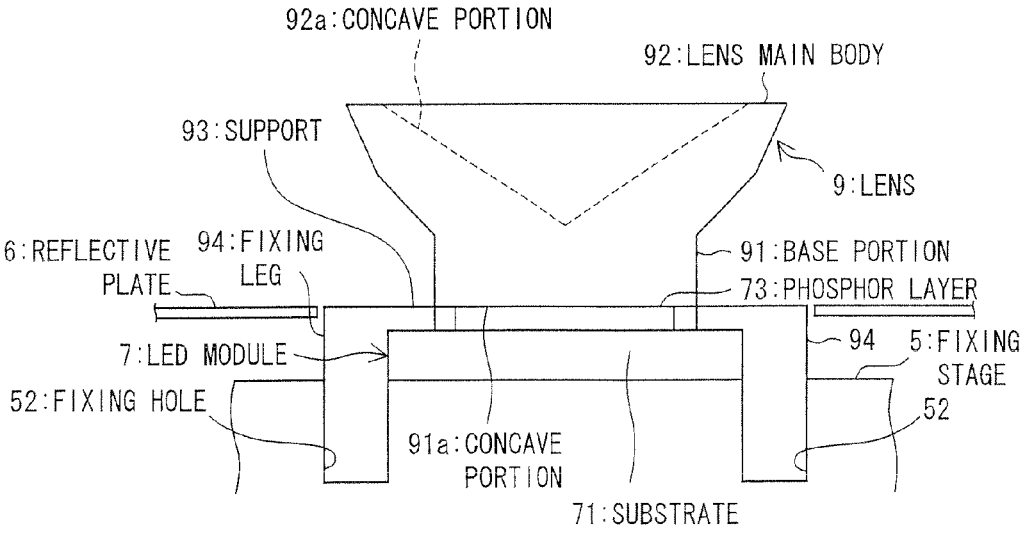
FIG. 8

As depicted in FIGS. 7 and 8, the lens 9 includes a base portion 91 and a lens main body 92 which have equivalent functions of the base portion 81 and the lens main body 82 of the lens 8, respectively. As such, the base portion 91 is provided with a concave portion 91*a* having an equivalent function of the concave portion 81*a* of the base portion 81, and the lens main body 92 is provided with a concave portion 92*a* having an equivalent function of the concave portion 82*a* of the lens main body 82.

Unlike the lens 8, the lens 9 includes a support 93 and fixing legs 94 instead of the fixing legs 83.

The support 93 is a rectangular plate member provided to surround the bottom end of the base portion 91 and supports the base portion 91 and the lens main body 92. The support 93 is disposed on the substrate 71.

The fixing legs 94 are provided for fixing the lens 9 on the fixing stage 5 and positioning the lens 9. Two such fixing legs 94 extend downward respectively from two opposed side surfaces of the support 93 so as to face each other across the lens 9. Here, one end of each fixing leg 94 is inserted into a fixing hole 52 provided in the fixing stage 5. This allows the lens 9 to be firmly fixed on the fixing stage 5. In addition, this makes it easy to position the lens 9 accurately on the substrate 71.

(What is Realized by LED Light Bulb)

In this modification, providing the lens 9 makes it possible to direct the outgoing light backward, as in the LED light bulb 1 provided with the lens 8. Further, in this modification, a bottom end surface of the lens 9 (support 93) is brought into surface contact with a top end surface of the substrate 71 of the LED module 7. This prevents the lens 9 from inclining and holds the LED module 7 down to the housing 3. Further, in this modification, the fixing legs 94 are provided below the base 91. Therefore, unlike the fixing legs 83 of the lens 8, the fixing legs 94 do not block reflected light from the lens main body 92. This allows the light output ratio to be raised in comparison with the LED light bulb 1 including the lens 8.

[Embodiment 2]

Figure 9:
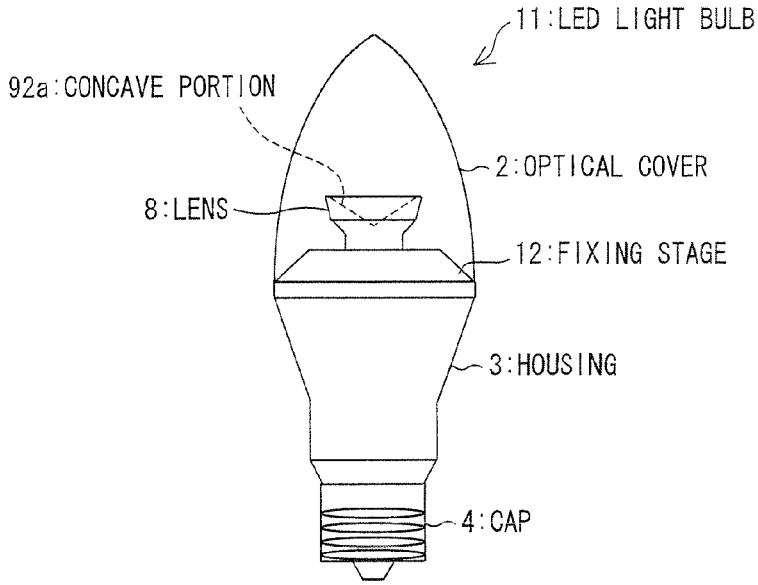
FIG. 9
Figure 10:
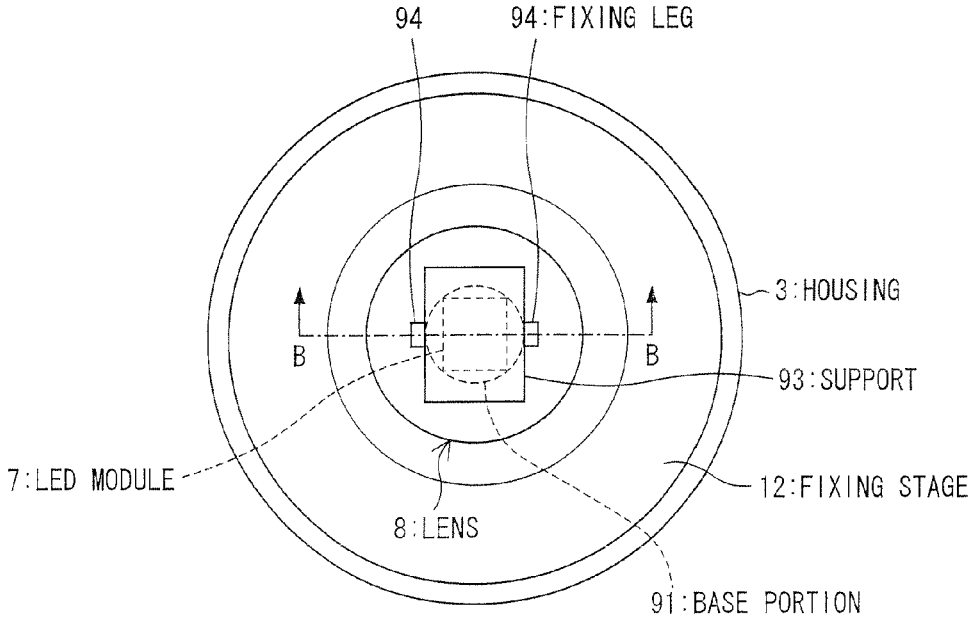
FIG. 10
Figure 11:
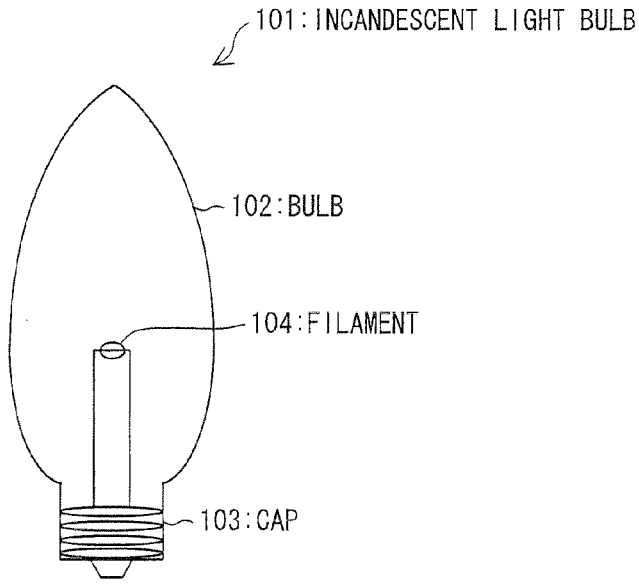
FIG. 11
Figure 12:
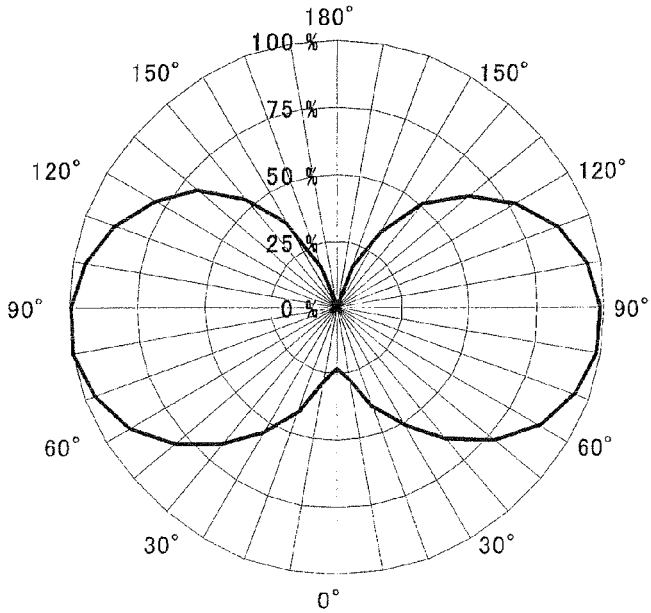
FIG. 12

The following describes another embodiment of the present invention with reference to FIGS. 9 and 10. FIG. 9 is a side view illustrating a light bulb 11 according to the present embodiment. FIG. 10 is an enlarged view illustrating where an LED module 7 and a lens 9 are located in the LED light bulb 11.

Note that, in the present embodiment, members having the same functions as those in Embodiment 1 are denoted by the same reference signs and are not explained.

(Configuration of LED Light Bulb)

As depicted in FIG. 9, the LED light bulb 11 of the present embodiment includes the lens 9 of the foregoing modification of the LED light bulb 1. Further, the light bulb 11 includes a fixing stage 12 instead of the fixing stage 5 of the LED light bulb 1.

The fixing stage 12 is formed to have a shape of a circular truncated cone that projects away from the cap 4, beyond the end of the housing 3 to which the optical cover 2 is attached (i.e., the fixing stage 12 is formed to have a shape of a circular truncated cone that has a given height). The lens 9 is fixed on a top of the fixing stage 12.

(What is Realized by LED Light Bulb)

With this configuration, the LED light bulb 11 can considerably reduce the angular range in which the outgoing light emitted through the lens 9 toward the back is blocked by the housing 3 and the like. This raises light output ratio of the LED light bulb 11. Therefore, in comparison with the LED light bulb 1, it is possible to increase an amount of the outgoing light emitted backward.

[General Overview of Embodiments]

As described above, the LED light bulb of the embodiments includes: an LED module which serves as a light source; a fixing stage on which the LED module is fixed; a housing which holds the fixing stage; an optical cover attached to the housing so as to cover the LED module; a cap attached to the housing so that the cap is on one side of the housing and the optical cover is on an opposite side of the housing; and a lens which directs part of outgoing light from the LED module to (i) first directions perpendicular to a front emission direction of the outgoing light or (ii) second directions leaning to the cap beyond the first directions.

With the above configuration, light is emitted from a light exit plane of the LED module omnidirectionally around front emission direction of the light. The light emitted in directions more leaned toward directions perpendicular to the front emission direction is lower in intensity. The lens directs part of the outgoing light from the LED module to (i) first directions perpendicular to the front emission direction of the outgoing light or (ii) second directions leaning to the cap beyond the first directions. This allows the LED light bulb to emit light that passes through the lens as well as light directed to lateral directions. As a result, the light can be emitted over a wide angular range.

In the foregoing LED light bulb, the lens preferably includes: a lens main body having a reflecting surface which reflects part of the outgoing light from the LED module; and a base portion which supports the lens main body above the LED module.

With this configuration, the lens main body is disposed in a high position because of the base portion. This makes it possible to reduce the angular range in which the light reflected by the lens main body is blocked by peripheral members such as the housing.

In the foregoing LED light bulb, the lens preferably has a concave portion at a bottom thereof. The concave portion is preferably formed to have a curved shape so that the outgoing light from the LED module enters almost vertically into the lens from the concave portion. As an alternative, the concave portion is preferably formed to have a curved surface of a conical shape.

A part of the light emitted from the LED module travels to the front emission direction, while the rest of the light enters invertically into the lens. The latter is partly reflected by the lens, thereby causing a loss of light quantity. On the other hand, if the outgoing light from the LED module enters vertically into the lens, the loss of light quantity is kept as small as possible. Therefore, it is possible to reduce the loss of light by forming the concave portion so as to have a curved shape, so that the outgoing light from the LED module enters almost vertically into the lens from the concave portion.

Further, by forming the concave portion so as to have a curved surface of a conical shape, the outgoing light from the LED module is refracted. This makes it possible to increase the light which travels to the lateral directions.

In the foregoing LED light bulb, the optical cover preferably forms a shape tapered to a peak. Such an optical cover having a shape tapered to a peak has higher light diffusion effect than a common optical cover having a spherical shape. Therefore, use of such an optical cover allows the light to be emitted over a wider angular range.

In the foregoing LED light bulb, the optical cover is preferably made of a transparent resin or glass. This allows to reduce a loss of light quantity when the light to be emitted through the lens passes through the optical cover. As such, light output ratio can further be raised.

In the foregoing light bulb, the optical cover is preferably made of a light-diffusive resin having a haze value of 99%. With this configuration, the light emitted through the lens can be diffused by the optical cover over a wider angular range.

In the foregoing LED light bulb, the optical cover preferably has a surface processed to have a diamond-like cutting pattern. With this configuration, the light emitted through the lens can be diffused by the optical cover over a wider angular range.

The foregoing light bulb preferably includes a reflective plate disposed to surround the LED module. With this configuration, a decrease of the outgoing light from the LED light bulb can be alleviated by using the reflective plate to further reflect the light which has been reflected to the vicinity of the LED module from the lens or from the optical cover after being emitted through the lens.

In the foregoing light bulb, the reflective plate preferably includes a holding portion which holds the LED module. This allows the LED module to be held also by the reflective plate. The LED light bulb is often disposed in such a manner that the LED module faces downward. With this configuration, the LED module is prevented from being suspended from the LED light bulb.

In the foregoing LED light bulb, the lens preferably has a leg portion extending below the lens, and the leg portion is preferably inserted into a hole provided in the fixing stage. With this configuration, the lens can be firmly fixed on the fixing stage. In addition, this makes it easy to position the lens.

In the foregoing LED light bulb, the fixing stage preferably has a top at a given height; and the lens is preferably disposed on the top. With this configuration, the lens is disposed in a high position. As such, it is possible to considerably reduce the angular range in which the light emitted through the lens toward the back is blocked by the housing and the like. This allows the light output ratio of the LED light bulb to be further raised.

The present invention is not limited to the description of the embodiments above, but may be altered within the scope of the claims. An embodiment based on a proper combination of technical means disclosed in different embodiments is encompassed in the technical scope of the present invention.

Industrial Applicability

In the LED light bulb of the present invention, the lens directs the outgoing light from the LED module to the lateral directions or directions leaning to the cap beyond the lateral directions. In consequence, it is possible to realize a backward light distribution of the LED light bulb, while keeping high light output ratio. Therefore, the LED light bulb is preferably applicable to an illumination device.

REFERENCE SIGNS LIST

1 LED Light Bulb
2 Optical Cover
3 Housing
4 Cap
5 Fixing Stage
6 Reflective Plate
8 Lens
9 Lens
7 LED Module
11 LED Light Bulb
12 Fixing Stage
62 Holding Claw (Holding Portion)
71 Substrate
72 LED Device
81 Base Portion
81*a* Concave Portion
81*b* Concave Portion
81*c* Concave Portion
82 Lens Main Body
82*a* Concave Portion
83 Fixing Leg (Leg Portion)
91 Base Portion
91*a* Concave Portion
92 Lens Main Body
92*a* Concave Portion
93 Support
94 Fixing Leg (Leg Portion)

The invention claimed is:

1. An LED light bulb comprising:
an LED module which serves as a light source;
a fixing stage on which the LED module and a reflective plate are fixed via fastners;
a housing which holds the fixing stage;
an optical cover attached to the housing so as to cover the LED module;
a socket cap attached to the housing so that the socket cap is on one side of the housing and the optical cover is on an opposite side of the housing; and
a lens which directs part of outgoing light from the LED module to (i) first directions perpendicular to a front emission direction of the outgoing light or (ii) second directions leaning to the cap beyond the first directions.

2. The LED light bulb according to claim 1, the lens including:
a lens main body having a reflecting surface which reflects part of the outgoing light from the LED module; and
a base portion which supports the lens main body above the LED module.

3. The LED light bulb according to claim 2, wherein:
the lens has a concave portion at a bottom thereof.

4. The LED light bulb according to claim 3, wherein:
the concave portion is formed to have a curved shape so that the outgoing light from the LED module enters almost vertically into the lens from the concave portion.

5. The LED light bulb according to claim 3, wherein:
the concave portion is formed to have a curved surface of a conical shape.

6. The LED light bulb according to claim 2, wherein:
the optical cover forms a shape tapered to a peak.

7. The LED light bulb according to claim 2, wherein:
the optical cover is made of a transparent resin or glass.

8. The LED light bulb according to claim 2, wherein:
the optical cover is made of a light-diffusive resin having a haze value of 99%.

9. The LED light bulb according to claim 2, wherein:
the optical cover has a surface processed to have a diamond-like cutting pattern.

10. The LED light bulb according to claim 2, including the reflective plate disposed to surround the LED module.

11. The LED light bulb according to claim 10, wherein: the reflective plate includes a holding portion which holds the LED module.

12. The LED light bulb according to claim 9, wherein: the lens has a leg portion extending below the lens, and the leg portion is inserted into a hole provided in the fixing stage.

13. The LED light bulb according to claim 1, wherein: the fixing stage has a top at a given height; and the lens is disposed on the top.

* * * * *